US010184316B2

(12) United States Patent
Flores Perez et al.

(10) Patent No.: US 10,184,316 B2
(45) Date of Patent: Jan. 22, 2019

(54) THREE POSITION INTERVENTIONLESS TREATMENT AND PRODUCTION VALVE ASSEMBLY

(71) Applicant: BAKER HUGHES, A GE COMPANY, LLC, Houston, TX (US)

(72) Inventors: Juan Carlos Flores Perez, The Woodlands, TX (US); James S. Sanchez, Tomball, TX (US); Beau R. Wright, Tomball, TX (US); Steve Rosenblatt, Houston, TX (US)

(73) Assignee: BAKER HUGHES, A GE COMPANY, LLC

( * ) Notice: Subject to any disclaimer, the term of this patent is extended or adjusted under 35 U.S.C. 154(b) by 545 days.

(21) Appl. No.: 14/844,897

(22) Filed: Sep. 3, 2015

(65) Prior Publication Data

US 2017/0067314 A1 Mar. 9, 2017

(51) Int. Cl.

| | |
|---|---|
| ***E21B 34/10*** | (2006.01) |
| ***E21B 43/08*** | (2006.01) |
| ***E21B 34/14*** | (2006.01) |
| *E21B 34/00* | (2006.01) |

(52) U.S. Cl.

CPC ..... *E21B 34/10* (2013.01); *E21B 34/14* (2013.01); *E21B 43/08* (2013.01); *E21B 2034/007* (2013.01)

(58) Field of Classification Search

CPC .... E21B 34/00; E21B 2034/002; E21B 34/10; E21B 34/24; E21B 43/08; E21B 2034/007; E21B 43/26; E21B 43/24; E21B 43/164

See application file for complete search history.

(56) References Cited

U.S. PATENT DOCUMENTS

| | | | | |
|---|---|---|---|---|
| 7,661,478 | B2 | 2/2010 | Palmer et al. | |
| 8,127,847 | B2 | 3/2012 | Richard et al. | |
| 8,291,982 | B2 | 10/2012 | Murray et al. | |
| 8,342,245 | B2 | 1/2013 | Richard et al. | |
| 2006/0124310 | A1* | 6/2006 | Lopez de Cardenas | E21B 34/06 166/313 |
| 2008/0156496 | A1 | 7/2008 | East | |
| 2008/0296019 | A1 | 12/2008 | Johnson et al. | |
| 2009/0044944 | A1 | 2/2009 | Murray et al. | |
| 2009/0056934 | A1* | 3/2009 | Xu | E21B 43/26 166/244.1 |
| 2009/0071655 | A1 | 3/2009 | Fay | |

(Continued)

FOREIGN PATENT DOCUMENTS

WO 2015110463 A2 7/2015

*Primary Examiner* — Yong-Suk Ro

(74) *Attorney, Agent, or Firm* — Shawn Hunter

(57) ABSTRACT

A first sleeve is shifted with a ball landed on a seat to open treating ports. At the conclusion of the treating such as fracturing, another ball is dropped on a seat in an adjacent sleeve. The adjacent sleeve shifts to contact the initial sleeve that was shifted earlier. When the sleeves abut the treating ports are closed by the second sleeve and the production ports that are preferably screened are also opened by the shifting of the second sleeve against the first sleeve. The first sleeve hits a travel stop in the housing to produce the full open position for the treating ports. The balls can be progressively larger in a bottom up direction for the procedure or the balls can all be the same size as the landing of a ball on the first sleeve reconfigures the sleeve above for the same sized ball.

25 Claims, 1 Drawing Sheet

(56) References Cited

U.S. PATENT DOCUMENTS

| | | | |
|---|---|---|---|
| 2009/0084553 | A1 | 4/2009 | Rytlewski et al. |
| 2014/0048271 | A1 | 2/2014 | Coon et al. |
| 2014/0262312 | A1 | 9/2014 | Tilley |

* cited by examiner

THREE POSITION INTERVENTIONLESS TREATMENT AND PRODUCTION VALVE ASSEMBLY

FIELDS OF THE INVENTION

The field of the invention is valve assemblies that can be selectively opened for a zone treatment and then reconfigured to a production position with a screened opening and more particularly where the various positions of the assembly are obtained without well intervention.

BACKGROUND OF THE INVENTION

Typically for a multi-zone completion the casing has an array of valves for access to each zone. These valves are typically run in closed so that tubing pressure can be built up to set tools such as external packers. The valves have been single purpose in the past so that for treatment a sliding sleeve valve is shifted to open an unobstructed port through which treatment of the formation can take place. One such treatment is fracturing but others such as acidizing or stimulation can also take place through the unobstructed port. When the treatment is completed the treatment valve is closed and a production valve that has a screened opening is moved to an open position. Sometimes these two valves are integrated into a single sliding sleeve that is shifted with a shifting tool or some other well intervention tool into the treatment and then the production positions. The screened opening helps to retain solids produced from the formation from entering the production string.

The following references present a good background of the current state of the art: U.S. Pat. No. 8,342,245; U.S. Pat. No. 8,127,847; US2008/0296019; US 2009/0071655; US2009/0044944; U.S. Pat. No. 8,291,982 and US2009/0056934. These designs either require well intervention or contemplate sleeve movement to open a single port. These designs increase the number of interventions and sleeve movements making procedures more complicated. What is needed and provided by the present invention is an interventionless way to open a treatment port and then a production port in a predetermined zone in an assembly where sleeves abut so that a first object on a seat opens the treatment port and a second object landed on a seat in an adjacent sleeve moves the sleeves in tandem to close the treatment port while opening the production port that is screened. The process repeats for adjacent zones preferably in a bottom up orientation so that the screened openings below are isolated with another object that lands higher up on a treatment sleeve for a zone further uphole. When all the zones are treated the objects can be produced back up to the surface and recovered. In one embodiment the objects are balls of a progressively larger diameter. In another embodiment the movement of a first sleeve can reconfigure the size of the seat in the adjacent sleeve in a manner known in the art so that the same size ball can be used for multiple sleeve movements. One version of such a design is shown in U.S. Pat. No. 7,661,478 which is fully incorporated herein as if fully set forth. These and other aspects of the present invention will be more readily apparent to those skilled in the art from a review of the preferred embodiment of the present invention as well as the associated drawing while recognizing that the full scope of the invention is to be determined by the appended claims.

SUMMARY OF THE INVENTION

A first sleeve is shifted with a ball landed on a seat to open treating ports. At the conclusion of the treating such as fracturing, another ball is dropped on a seat in an adjacent sleeve. The adjacent sleeve shifts to contact the initial sleeve that was shifted earlier. When the sleeves abut the treating ports are closed by the second sleeve and the production ports that are preferably screened are also opened by the shifting of the second sleeve against the first sleeve. The first sleeve hits a travel stop in the housing to produce the full open position for the treating ports. The balls can be progressively larger in a bottom up direction for the procedure or the balls can all be the same size as the landing of a ball on the first sleeve reconfigures the sleeve above for the same sized ball.

DETAILED DESCRIPTION OF THE PREFERRED EMBODIMENT

Figure 1:
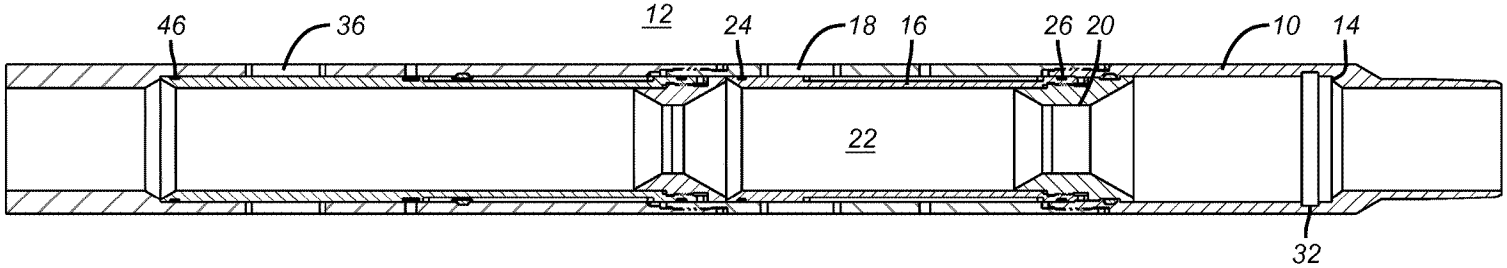
FIG. 1 shows a section view in the run in position with spaced ports in the closed position.
Figure 2:
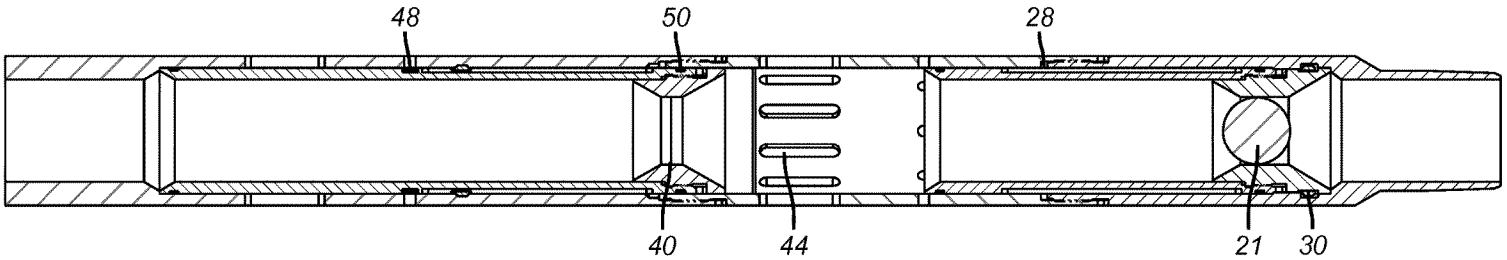
FIG. 2 is the view of FIG. 1 with the first sleeve shifted to expose ports for treatment.
Figure 3:
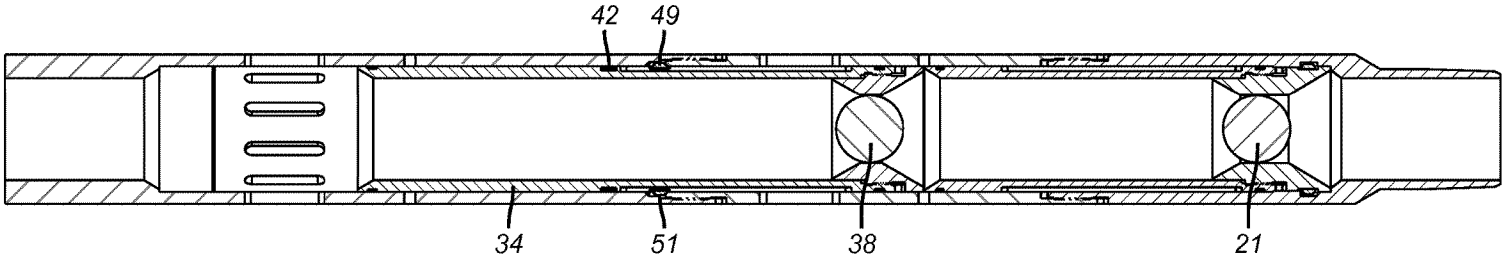
FIG. 3 is the view of FIG. 2 with the treatment ports closed with the second sleeve that is shifted to also open the production or injection ports.

The FIG. shows one of a possible array of spaced housings 10 that are disposed adjacent a respective zone 12 in a borehole. Housing 10 has an internal shoulder 14 that acts as a travel stop for sliding or rotating sleeve 16. In the run in position the treating ports 18 are all closed so that the tubular string of which housing 10 is a part can be pressurized to set tools such as packers or valves to name a few examples. Sleeve 16 has a seat 20 in a passage 22. When a ball 21 initially lands on seat 20 and pressure is built up the sleeve 16 will move to the stop or shoulder 14. This will result in opening the unobstructed ports 18 as spaced seals 24 and 26 no longer straddle ports 18. The position of the sleeve 16 can be initially secured with one or more shear devices schematically illustrated as 28. The shifted position of the sleeve 16 can also be secured such as with a snap ring 30 that can expand into a recess 32 when shifting of sleeve 16 against stop 14 has fully occurred. The treatment can take place through now fully opened ports 18 that have no obstruction.

At the conclusion of the treatment in zone 12 it is necessary to close the ports 18 and open the screened ports 36 using movement of sleeve 34. This is accomplished with a ball 38 landed on seat 40 and pressure applied to break shear pins 42 so that movement of sleeve 34 brings its ports 44 into alignment with housing ports 36 such that seal stacks 46 and 48 on sleeve 34 straddle housing ports 36. At the same time seal stack 50 at the lower end of sleeve 34 travels past openings 18 so that openings 18 are effectively closed by sleeve 34 as its seal stacks 48 and 50 effectively straddle the ports 18. This happens when sleeve 34 hits sleeve 16 that had earlier shifted to open ports 18 as described above. The shifted position of sleeve 34 can also be locked in with a snap ring 49 expanding into a housing recess 51. The balls that land on seats 20 or 40 can be produced to the surface, or can disintegrate with exposure to well fluid or can be blown through the seats or milled out with all the seats.

The described device can facilitate the opening of treating ports without intervention. The treating ports are opened with a first sleeve and closed by a different second sleeve. The second sleeve can have ports that come into alignment with housing ports 36 or the sleeve 34 can simply move past the housing ports 36 while also blocking ports 18. The moved position of the first sleeve provides a travel stop for the second sleeve as the second sleeve at the same time closes the treatment ports and opens the screened production ports. Optionally the second sleeve can have its own discrete travel stop independent of the first sleeve such as another shoulder in the housing that acts as a second sleeve travel stop.

As an alternative design the ports 36 can be eliminated and the ports 18 can be transitioned from full open and unobstructed for treatment to screened open due to movement of sleeve 34 with the changes being that sleeve openings 44 can conform to openings 18 and have screens in openings 44 that get presented in alignment with openings 18 when sleeve 34 is shifted. In essence openings 44 can be placed between seal stacks 48 and 50 lower down on sleeve 34 than shown and ports 36 as well as seal stack 46 can be eliminated. Ports that are employed in production or injection after treating need not be screened. They can be chokes or restrictors or a valved opening as an alternative The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc. Another operation can be production from said zone or injection into said zone.

As opposed to prior spring-loaded designs using a single sleeve that required continuous pressure application after the initial shift that compressed the spring to keep the treatment port open, the present design positively drives sleeves to hold the treatment and production ports open regardless of applied pressure from the surface, which can be interrupted causing the sleeve that was spring loaded to shift at an importune time. In the preferred design the shifted position of the sleeves can be retained such as with snap rings or other fasteners. The sleeves can shift axially with a single pressure application or pressure cycles can be combined with j-slots to get the desired axial movement to open or close ports by combining the axial with rotary movement of the sleeves. While progressively larger balls in a bottom up sequence are preferred additional mechanical complexity can be introduced to have a given ball reconfigure a seat it has passed to accept a subsequent ball that is of the same dimension.

The above description is illustrative of the preferred embodiment and many modifications may be made by those skilled in the art without departing from the invention whose scope is to be determined from the literal and equivalent scope of the claims below.

We claim:

1. A subterranean treatment and production or injection assembly for multiple zones, comprising:

at least one housing respectively in each said multiple zones to be treated and produced, wherein said at least one housing in each said zones to be treated and produced has a passage therethrough and at least one first wall port;

a pressure responsive first sleeve in said passage to selectively and directly open one of said at least one first wall port a first of said zones by shifting in one axial direction in said passage;

a pressure responsive second sleeve in said at least one housing to selectively close the one of said at least one first wall port after being opened directly by said pressure responsive first sleeve for production or injection by moving in said one axial direction in said passage.

2. The assembly of claim 1, wherein:

said at least one said first wall port is unobstructed.

3. The assembly of claim 1, wherein:

said first sleeve movable against a travel stop in said housing for the open position of the one of said at least one said wall port.

4. The assembly of claim 3, wherein:

said second sleeve movable with respect to said first sleeve to place a screen in alignment with at least one second wall port.

5. The assembly of claim 4, wherein:

said second sleeve movable into contract with said first sleeve for alignment of a screen, choke or restrictor with said at least one second wall port.

6. The assembly of claim 1, wherein:

the one of said at least one first wall port comprises axially spaced first and second wall ports with said first wall ports being unobstructed.

7. The assembly of claim 6, wherein:

movement of said second sleeve relative to said first sleeve closes the one of said first wall port and opens said second wall port.

8. The assembly of claim 7, wherein:

said second sleeve engages said first sleeve as the one of said first wall port is closed and said second wall port is opened.

9. The assembly of claim 8, wherein:

said first sleeve movable against a travel stop in said housing for the open position of the one of said first wall port.

10. The assembly of claim 8, wherein:

said first or second sleeve are selectively axially initially restrained by a breakable member.

11. The assembly of claim 8, wherein:

said first or second sleeve axially restrained after initial movement.

12. The assembly of claim 8, wherein:

said axially spaced first and second wall ports each comprise at least one row of ports.

13. The assembly of claim 8, wherein:

said at least one housing in a respective zone comprises a plurality of connected housings on a tubular string.

14. The assembly of claim 6, wherein:

said at least one production or injection port is screened, choked or otherwise restricted.

15. A subterranean treatment method, comprising:

delivering the assembly of claim 1 to predetermined locations;

performing a treatment with the assembly of claim 1 at said zones;

producing or injecting with the assembly of claim 1 at said zones.

16. The method of claim 15, comprising:

performing hydraulic fracturing, stimulation, tracer injection, cleaning, acidizing, steam injection, water flooding, cementing as said treatment.

17. The method of claim 15, wherein:

providing as the one of said at least one first wall port at least one a treatment port spaced from at least one production or injection port;

sequentially opening said at least one treatment port and said at least one production or injection port with movable sleeves.

18. A subterranean treatment method, comprising:

delivering the assembly of claim 1 to predetermined locations;

performing a treatment with the assembly of claim 1 at said zones;

producing or injecting with the assembly of claim 1 at said zones;

providing as said the one of at least one first wall port at least one a treatment port spaced from at least one production or injection port;

sequentially opening said at least one treatment port and said at least one production or injection port with movable sleeves;

providing a seat for an object on each of said movable sleeves; applying pressure to said seated object to respectively move said sleeves.

19. The method of claim 18, comprising:

using balls that are the same or a different size on said seats in said movable sleeves.

20. A subterranean treatment and production or injection assembly for multiple zones, comprising:

at least one housing respectively in each said multiple zones to be treated and produced, wherein said at least one housing in each said zones to be treated and produced has a passage therethrough and at least one first wall port:

a pressure responsive first sleeve in said passage to selectively open one of said at least one first wall port a first of said zones;

a pressure responsive second sleeve in said at least one housing to selectively closes the one of said at least one first wall port for production or injection;

said first and second sleeves each further comprising a seat each selectively closed by an object landing on said seat, said sleeves responsive to pressure on said object placed on said seat of said first and second sleeves.

21. A subterranean treatment and production or injection assembly for multiple zones, comprising:

at least one housing respectively in each said multiple zones to be treated and produced, wherein said at least one housing in each said zones to be treated and produced has a passage therethrough and at least one first wall port:

a pressure responsive first sleeve in said passage to selectively open one of said at least one first wall port a first of said zones;

a pressure responsive second sleeve in said at least one housing to selectively closes the one of said at least one first wall port for production or injection;

said first sleeve movable against a travel stop in said housing for the open position of the one of said at least one said wall port;

said second sleeve movable with respect to said first sleeve to place a screen in alignment with at least one second wall port;

said second sleeve comprises screened openings selectively placed in alignment with said at least one second wall port.

22. The assembly of claim 21, wherein:

said screened openings straddled by spaced seal stacks on said second sleeve.

23. The assembly of claim 22, wherein:

said first or second sleeve are selectively axially initially restrained by a breakable member.

24. The assembly of claim 22, wherein:

said first or second sleeve axially restrained after initial movement.

25. A subterranean treatment and production or injection assembly for multiple zones, comprising:

at least one housing respectively in each said multiple zones to be treated and produced, wherein said at least one housing in each said zones to be treated and produced has a passage therethrough and at least one first wall port;

a pressure responsive first sleeve in said passage to selectively open one of said at least one first wall port a first of said zones;

a pressure responsive second sleeve in said at least one housing to selectively closes the one of said at least one first wall port for production or injection;

the one of said at least one first wall port comprises axially spaced first and second wall ports with the one of said first wall ports being unobstructed;

movement of said second sleeve relative to said first sleeve closes the one of said first wall port and opens said second wall port;

said second sleeve engages said first sleeve as the one of said first wall port is closed and said second wall port is opened:

said first and second sleeves each further comprising a seat each selectively closed by an object landing on said seat, said sleeves responsive to pressure on said object placed on said seat of said first and second sleeves.

* * * * *